US006471326B2

(12) United States Patent
Tachihara et al.

(10) Patent No.: US 6,471,326 B2
(45) Date of Patent: Oct. 29, 2002

(54) INK-JET HEAD AND INK-JET PRINTING APPARATUS

(75) Inventors: Masayoshi Tachihara, Chofu; Michinari Mizutani, Tokyo, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/900,032

(22) Filed: Jul. 9, 2001

(65) Prior Publication Data

US 2001/0050704 A1 Dec. 13, 2001

Related U.S. Application Data

(62) Division of application No. 09/144,450, filed on Sep. 1, 1998, now Pat. No. 6,280,020.

(30) Foreign Application Priority Data

Sep. 4, 1997 (JP) ..... 9-239773
Sep. 11, 1997 (JP) ..... 9-246890

(51) Int. Cl.[7] ..... B41J 29/393; B41J 2/05
(52) U.S. Cl. ..... 347/19
(58) Field of Search ..... 347/19, 47, 23, 347/45, 44, 63, 92, 94, 65, 67

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,550,326 A | | 10/1985 | Allen et al. | 347/44 |
| 4,558,333 A | | 12/1985 | Sugitani et al. | 347/47 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 5,159,354 A | | 10/1992 | Hirasawa et al. | 347/65 |
| 5,317,346 A | | 5/1994 | Garcia | 347/63 |
| 6,174,049 B1 | * | 1/1997 | Tachihara et al. | 347/65 |
| 6,137,510 A | * | 10/1997 | Sato et al. | 347/63 |
| 6,186,616 B1 | * | 2/1998 | Inoue et al. | 347/45 |
| 6,280,020 B1 | * | 8/1998 | Tachihara et al. | 347/65 |
| 6,286,933 B1 | * | 9/1998 | Murakami et al. | 347/47 |

FOREIGN PATENT DOCUMENTS

| | | |
|---|---|---|
| EP | 461 935 | 12/1991 |
| EP | 465 071 | 1/1992 |
| EP | 783 973 | 7/1997 |
| JP | 54-56847 | 5/1979 |
| JP | 59-123670 | 7/1984 |
| JP | 59-138460 | 8/1984 |
| JP | 59-138461 | 8/1984 |
| JP | 60-71260 | 4/1985 |
| JP | 4-10940 | 1/1992 |
| JP | 4-10941 | 1/1992 |
| JP | 4-10942 | 1/1992 |
| JP | 9-254413 | 9/1997 |

OTHER PUBLICATIONS

Official Search Report for Eur. Pat. Appln. No. 98 116 674.7 (Nov. 15, 1999).

* cited by examiner

*Primary Examiner*—Michael Nghiem
*Assistant Examiner*—Charles W. Stewart, Jr.
(74) *Attorney, Agent, or Firm*—Fitzpatrick, Cella, Harper & Scinto

(57) ABSTRACT

In order to enable high speed printing with maintaining reliability of ink ejection, an auxiliary hole is provided in an upper wall forming a liquid passage. An opening area of the auxiliary hole is set to be greater than or equal to three times of an opening area of an ejection opening, and a minimum distance between the auxiliary hole and the ejection opening is set to be greater than or equal to three times of a height of the liquid passage.

17 Claims, 15 Drawing Sheets

INK-JET HEAD AND INK-JET PRINTING APPARATUS

CROSS REFERENCES TO RELATED APPLICATION

This application is a division of application Ser. No. 09/144,450, filed on Sep. 1, 1998 U.S. Pat. No. 6,280,020.

This application is based on patent application Ser. No. 239,773/1997 filed on Sep. 4, 1997 in Japan and No. 246,890/1997 filed on Sep. 11, 1997 in Japan, the content of which is incorporated by reference.

BACKGROUND OF THE INVENTION

1. Filed of the Invention

The present invention relates to an ink-jet head and an ink-jet printing apparatus performing printing by ejecting an ink droplet toward a printing medium.

2. Description of the Related Art

As an ink-jet head, there is a head which instantly causes bubbling in ink by thermal energy supplied from a heater to perform printing by ejecting the ink with growth of the bubble. Such head is particularly superior in high speed printing and high density printing. In such head, the head employing a system, in which the bubble of the ink generated on the heater is communicated with the atmosphere, has been known (Japanese Patent Application Laid-open No. 10940/1992, Japanese Patent Application Laid-open No. 10941/1992, Japanese Patent Application Laid-open No. 10942/1992 and so on). The first feature of the head of this type is high ink ejection speed and high reliability. The second feature of the head of this type is that substantially all of the ink between the heater and the ejection opening can be ejected to make volumes of the ejected ink through all ejection openings substantially constant to make density fluctuation small.

According to progress of printing technology, it has been required to print smaller ink droplets with higher density. However, to make the ink droplet smaller, an ink passage becomes thinner which tends to cause lowering of ejection efficiency namely lowering of ejection speed. Therefore, problems of the reliability, such as unstability of the direction of ink ejection, unstability of ink ejection caused by increasing of the viscosity of the ink due to evaporating of the volatile component in the ink during the head resting, are caused. In this respect, the head of the type set forth above, namely the head, in which the bubble is communicated with the atmosphere, is difficult to cause the foregoing problems and can be adapted to demand for high quality printing in the future.

However, in the head of the type set forth above, the following problems are encountered. Namely, since the bubble is communicated to the atmosphere during growth of the bubble, the bubble becomes large meniscus upon communication with the atmosphere to make a re-fill time of the ink long. When next bubbling is caused without waiting for completion of re-filling, in certain case, the ink cannot form normal droplet and to cause so-called mist phenomena, in which the ink becomes a mist state, and the ink may fly in various direction to stain the printing medium.

On the other hand, conventionally, as an output means of a personal computer and so on, printers of various printing types are employed. According to speeding up of process speed of the personal computer, spreading of internet, demand for speeding up of a color image printing is increasing. Therefore, an ink-jet printer which can perform high speed printing comparable with a laser printer, can be easily adapted for color printing, and is low cost, has been widely used.

One of typical printing system of the ink-jet printers is a bubble-jet printing system which is a system heating and evaporating the ink by a thermal energy generating means and ejecting the ink droplet through the ejection opening by a pressure of the bubble generated. After ejection of the ink droplet, the vapor of the ink within the bubble is condensed to return into a liquid state to finally extinguish the bubble. While the ink in the ink passage is reduced by ejection of the ink, the ink is filled through an ink supply passage.

FIG. 15 is an explanatory illustration showing a construction of a head of a bubble-jet printing system associated with the background art. A plurality of ink passages 22 are branched from the ink supply passage 21. Thus, the ink passages 22 and the ink supply passage 21 are communicated with each other. On a tip end of each ink passage 22, an ejection opening 23 for the ink droplet is provided. In opposition to each ejection opening 23, a heater 24 (see FIG. 17) as a thermal energy generating means is provided. On the other hand, by slightly differentiating lengths of respective ink passages 22 (distance from the branching position 25 from the ink supply passage 21 to the ejection opening 23) instead of making them uniform, the positions of the ejection openings 23 are offset to permit high density printing. Since the center of the ejection opening 23 and the center of the heater 24 are located in opposition, the distance from the branching position 25 from to the ejection opening 23 is consistent with a distance (hereinafter referred to as "distance C-H") from the branching position 25 to the heater 24.

In the shown example, two hundreds fifty-six ink passages 22 are provided, in total. However, in FIG. 15, only thirty-two ink passages 22 are shown. These ink passages 22 are divided into two sets, i.e. even number passages located on the left side in the drawing and odd number passages located on the right side. In each set, the ink passages are grouped per eight into sixteen groups. The heaters 24 of eight ink passages 22 in the same group are driven simultaneously in time division so that sixteen times driving in total of heaters is set at one cycle. It should be noted that lengths of the ink passages 22 (distances from the branching position 25 to the ejection opening 23) are divided into five kinds.

Discussing this example, concerning the passages in the even number order in sequence (hereinafter referred to as "even number passages"), eight passages Seg0, 32, 64, 96, 128, . . . 224 constitute a first group. Eight passages Seg10, 42, 74, . . . 234 constitute a second group. Eight passages Seg20, 52, . . . 244 constitute a third group. Eight passages Seg30, 62, . . . 254 constitute a fourth group. Eight passages Seg8, 40, . . . 232 constitute a fifth group. Eight passages Seg18, 50, . . . 242 constitute a sixth group. Eight passages Seg28, 60, . . . 252 constitute a seventh group. Eight passages Seg6, 38, . . . 230 constitute a eighth group. Eight passages Seg16, 48, . . . 240 constitute a ninth group. Eight passages Seg26, 58, . . . 250 constitute a tenth group. Eight passages Seg4, 36, . . . 228 constitute a eleventh group. Eight passages Seg14, 46 . . . 238 constitute a twelfth group. Eight passages Seg24, 56, . . . 248 constitute a thirteenth group. Eight passages Seg2, 34, . . . 226 constitute a fourteenth group. Eight passages Seg12, 44, 236 constitute a fifteenth group. Eight passages Seg22, 54, . . . 246 constitute a sixteenth group. As can be seen from the above, grouping of the ink passages are done by grouping every sixteen passages.

Also, the passages in the odd number order in sequence (hereinafter referred to as "odd number passages"), similarly to the even number passages, the passages are grouped into sixteen groups, such that eight passages Seg1, 33, 65, 97, 129, . . . 225 constitute a first group, eight passages Seg11, 43, 75, . . . 235 constitute a second group, eight passages Seg21, 53, . . . 245 constitute a third group, . . . eight passages Seg23, 55, . . . 247 constitute a sixteenth group. Accordingly, each group is consisted of eight even number passages and eight odd number passages and thus is consisted of sixteen passages in total.

Upon printing, the first group to the sixteenth group are driven per group in sequential order. An interval after driving one group to drive the next group is 5.9 μsec.

In case of FIG. 15, the even number passages are driven to eject the ink droplet in a sequential order from the passage having short distance C-H, and the odd number passages are driven to eject the ink droplet in a sequential order from the passage having long distance C-H. The ink passages performing ejection of the ink later is influenced by the ink passages performed ink ejection earlier. Namely, the passages Seg22, 54, . . . 246 and Seg23, 55, . . . 247 of the sixteenth group is influenced by vibration of the ink passages of all groups driven in advance. Particularly, in case of the ink passage having short distance C-H, influence of vibration due to ink ejection in other group should be extended to the meniscus portion in the ejection opening portion.

FIG. 16 relates to the ink passage (the ink passage having short distance between C-H) of the sixteenth group of the even number passages of FIG. 15, and is a graph taking an elapsed time from application of the drive pulse to the first group on a horizontal axis and a position of meniscus of the ejection opening portion on a vertical axis. It should be noted that the position of the meniscus is expressed by taking the end face of the ejection opening as zero, that a positive value represents a projecting amount bulging outwardly from the ejection opening and a negative value represents an inwardly retracting amount from the ejection opening. Until the heaters of the ink passages of the sixteenth group are driven, while driving of the heaters of other groups are performed for fifteen times, the meniscus of the sixteenth group continuously expand to increase projecting amount from the end face of the ejection opening.

According to a result experimentally obtained through study by the inventors, projecting amount of the meniscus becomes greater than or equal to +3 μm from the ejection opening. Then, as shown in FIG. 17, upon driving of the heater, the ink droplet 9 for printing is ejected in spherical shape, and the separated late ink droplet 9 is ejected to cause so-called broken droplet ejecting phenomenon. In this case, in comparison with other ejection openings, ink amount becomes large to make the droplet greater. For example, when so-called black solid printing is performed by ejecting ink through all ejection openings, black stripes locally having higher density can appear cyclically on the printing surface to cause degradation of the printing quality. In FIG. 17, the reference numeral 29*a* denotes a meniscus defined after ink ejected.

In case of the odd number passages of FIG. 15, the heaters are driven so that the ink droplets are ejected in sequential order from the ink passages having long C-H distance. The ink passage having the shortest C-H distance is present in the first group. In normal printing operation, since driving of the heaters in time division manner (sixteen times of driving of the heaters=one cycle) is repeated, the position of the meniscus of the ink in the first group becomes equivalent to that state of FIG. 16 due to influence of vibration of the ink passage caused by ejection of ink droplets from the second group to the sixteenth group and further by ejection of the ink droplets before performing ejection of the first group in the next cycle. Accordingly, since driving cycle of the heaters in time division manner is repeated, irrespective of the group belonging, the ink passage having short C-H distance can cause broken droplet ejection phenomenon.

SUMMARY OF THE INVENTION

It is a first object of the present invention to enable high speed printing with maintaining reliability of ink ejection. Also, another object of the present invention to enable high quality printing without causing mist phenomenon.

A further object of the present invention is to provide an ink-jet head and an ink-jet printing apparatus which can prevent broken droplet ejection phenomenon to achieve high quality printing.

In a first aspect of the present invention, there is provided an ink-jet head capable of ejecting ink from an ejection opening located in opposition to an electrothermal transducer by generating bubble according to thermal energy applied from the electrothermal transducer to ink within an ink passage, wherein the ink passage is designed for supplying ink to the ejection opening; an auxiliary hole opened to outside is provided in an upper wall portion of the ink passage; an opening area of the auxiliary hole is greater than or equal to three times of an opening area of the ejection opening; and a minimum distance between the auxiliary hole and the ejection opening is greater than or equal to three times of a height of the ink passage.

In a second aspect of the present invention, there is provided an ink-jet printing apparatus including: an ink-jet head defined in the above first aspect; and shifting means for relatively shifting the ink-jet head and a printing medium.

In a third aspect of the present invention, there is provided an ink-jet head including an ink supply passage, a plurality of ink passages branched from the ink supply passage, ejection openings provided at respective tip ends of the ink passages and a thermal energy generating means for generating thermal energy used for ejecting ink from the ejection openings, wherein a dummy hole portion for buffering pressure variation and vibration of ink being provided between a branching portion between the ink supply passage and the ink passages and the thermal energy generating means, in at least one of the plurality of ink passages.

In a fourth aspect of the invention, there is provided an ink-jet printing apparatus including: an ink-jet head as defined in the above third aspect; and means for mounting the ink-jet head.

The present invention improves printing characteristics, such as reliability of ink ejection, stability of ink ejection, printing quality and so on, and enables high speed printing by specifying sizes and positional relationship of ejection openings and auxiliary holes.

Also, by the present invention, fluctuation of the ink pressure and vibration of the ink upon ejection of the ink droplet are absorbed by the auxiliary holes serving as dummy holes, outward bulging of the ink in the meniscus of the ink passage to subsequently perform ejection of the ink droplet can be restricted. As a result, broken droplet ejection phenomenon can be prevented and uniform ejection of the ink droplet becomes possible in overall ink passages to improve printing quality.

The above and other object, effects, features and advantages of the present invention will become more apparent from the following description of embodiment thereof taken in conjunction with the accompanying drawings.

DESCRIPTION OF THE PREFERRED EMBODIMENT

The preferred embodiments of the present invention will be discussed based on the drawings.

(First Embodiment)

Figure 1:
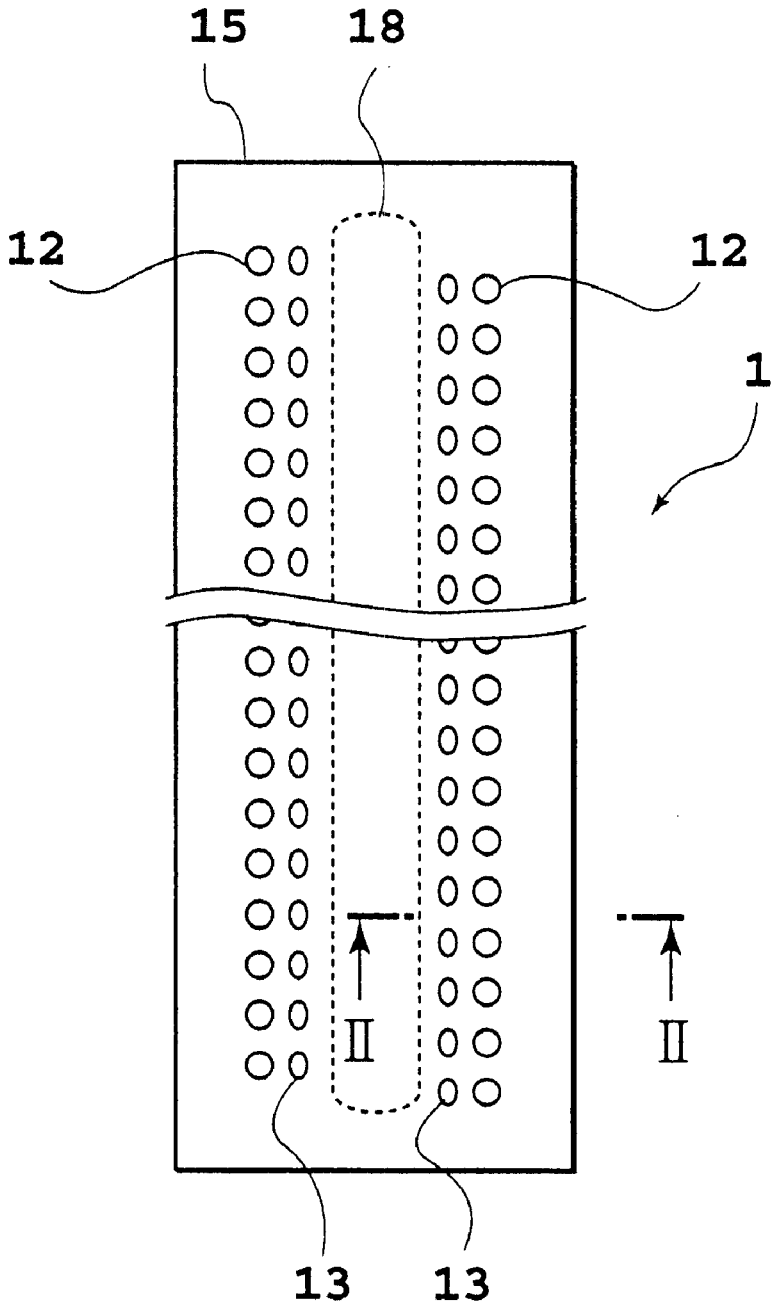
FIG. 1 is a plan view of the first embodiment of an ink-jet head according to the present invention.
Figure 2:
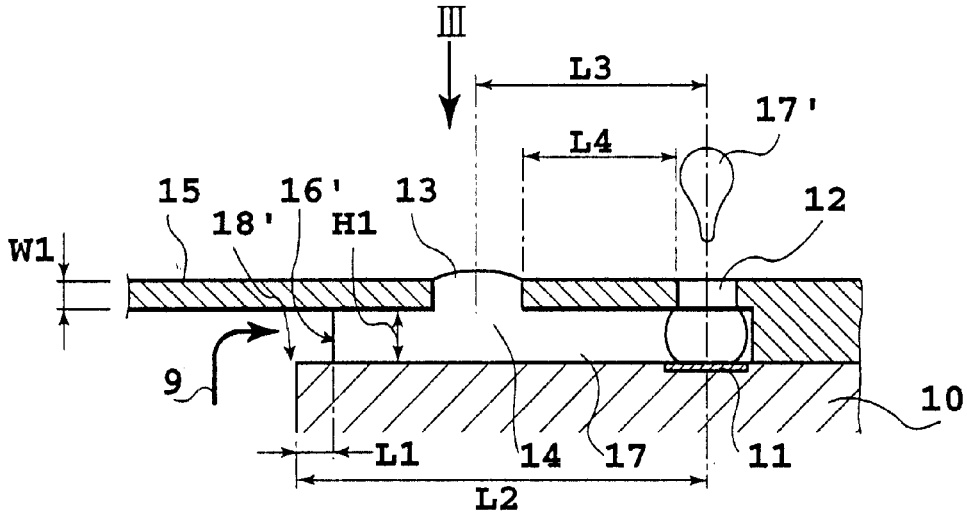
FIG. 2 is an enlarged section taken along line II—II of FIG. 1.
Figure 3:
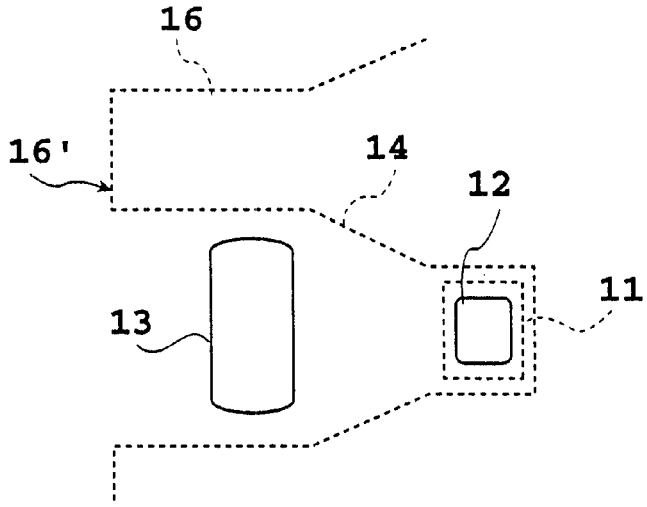
FIG. 3 is an illustration as viewed along an arrow III of FIG. 2.

FIGS. 1, 2 and 3 are illustrations for explaining the first embodiment of the present invention. FIG. 1 is a plan view of an ink-jet head 1, FIG. 2 is an enlarged section along line. II—II of FIG. 1, and FIG. 3 is an illustration as viewed along an arrow III of FIG. 2.

The head 1 is designed to heat ink 17 by a heating resistors (electrothermal transducer) 11 to generate a bubble to eject an ink droplet 17' through an ejection openings 12. The reference numeral 10 denotes a Si (silicon) substrate. On the substrate 11, heating resistors 11 (also referred to as "heater") as electrothermal transducers are provided. The surface of the heating resistor 11 is placed in opposition to the ejection opening 12 in substantially parallel relationship. The reference numeral 18 denotes an ink supply opening defined in the substrate 10. On each side of the ink supply opening 18, sixty-four ejection openings 12 are arranged. A row of the ejection openings 12 on the left side of the ink supply opening 18 and a row on the right side are arranged with a pitch of 84.6 $\mu$m in vertical direction in FIG. 1 and the ejection openings 12 on the left and right sides are arranged in staggered fashion to be obliquely opposed with 42.3 $\mu$m of offset magnitude.

The ink 17 is introduced from a not shown tank through the ink supply opening 18 and supplied to a portion of the heating resistor 11 in the direction of arrow 9 in FIG. 2. The reference numeral 14 denotes a liquid passage (ink passage) for supplying the ink from the ink supply opening 18 to respective heating resistors 11 and which are separated by partitioning walls 16. A distance L1 between an end 16' of each partitioning wall 16 and an edge 18' of the ink supply opening 18 is 10 $\mu$m. A distance L2 between a center of the heating resistor 11 and the edge 18' of the ink supply opening 18 is 111 $\mu$m. A height H1 of the liquid passage 14 is 12 $\mu$m. In the drawing, the reference numeral 13 denotes an auxiliary hole which is a feature of the present invention. The auxiliary hole 13 is provided in an upper plate 15 of the liquid passage 14. A thickness W1 of the upper plate 15 is 8 $\mu$m.

Sizes of the ejection opening 12 and the auxiliary hole 13 are respectively 22 $\mu$m×22 $\mu$m and 30 $\mu$m×54 $\mu$m. Both of the ejection opening 12 and the auxiliary hole 13 are provided with rounded portion of 4 $\mu$m of radius at four corners. A distance L3 between the centers of the ejection opening 12 and the auxiliary hole 13 is 65 $\mu$m, and a minimum distance L4 therebetween is 40 $\mu$m.

In case of the shown embodiment, a distance (H1+W1) from the heating resistor 11 to the upper surface of the ejection opening 12 is short in a extent of 20 $\mu$m. Therefore, the ink between the heating resistor 11 and the upper surface of the ejection opening 12 is ejected as an ink droplet 17' substantially as is. Before extinction of the generated bubble, the bubble is communicated with the atmosphere. FIG. 2 shows the behavior of the bubble to communicate with the atmosphere. By generation and growth of the bubble, the ink 17 is ejected from the ejection opening 12 to slightly bulged outwardly from the auxiliary hole 13. The maximum bulging amount is 6 $\mu$m in height from the upper surface of the upper plate 15 forming the orifice plate and 3800 $\mu m^3$ in volume. It should be noted that the volume of the ink droplet 17' to be ejected is 900 $\mu m^3$.

By bulging of the ink 17, a pressure of the bulging portion is elevated to assist for re-filling of the ink 17 at the next timing. In the shown embodiment, a period from initiation of application of an electrical pulse to the heating resistor 11 to re-filling of the ink 17 through ejection of the ink droplet 17' (also referred to as "re-filling period") is 52 $\mu$sec. As a comparative example, when the auxiliary hole 13 is not present, the period required was 76 $\mu$sec.

If the position of the auxiliary hole 13 is closer to the ejection opening 12 than that in the shown embodiment, the ink droplet is ejected from the auxiliary hole 13 or even when the ink droplet is not ejected, the circumference of the ejection opening 12 may be wetted to cause plugging of the ejection opening 12 with the ink in the worst case to make continuous use difficult. Conversely, when the position of the auxiliary hole 13 is located at a position of greater distance from the ejection opening 12 than the shown embodiment, a resistance of the flow passage between the auxiliary hole 13 and the ejection opening 12 becomes higher to degrade effect in shortening a re-fill period of the ink 17.

Next, size of the auxiliary hole 13 will be explained. When the size of the auxiliary hole 13 is too small, while elevation of pressure becomes sufficient, a capacity (volume) to store the bulging ink 17 becomes smaller. Conversely, when the size of the auxiliary hole 13 is excessively large, a curvature radius of the bulging ink 17 becomes large to make elevation of the pressure insufficient to degrade effect of shortening of re-fill period.

In the foregoing viewpoint, in the present invention, an opening area of the auxiliary hole 13 provided in the liquid passage is set to be three times or more of the opening area of the ejection opening 12, and a minimum distance L4 therebetween is set to be three times or more of the height Hi of the liquid passage 14. Thus, effectiveness of particularly setting the size and position of the auxiliary hole 13 could be confirmed by the following experiments.

Figure 7:
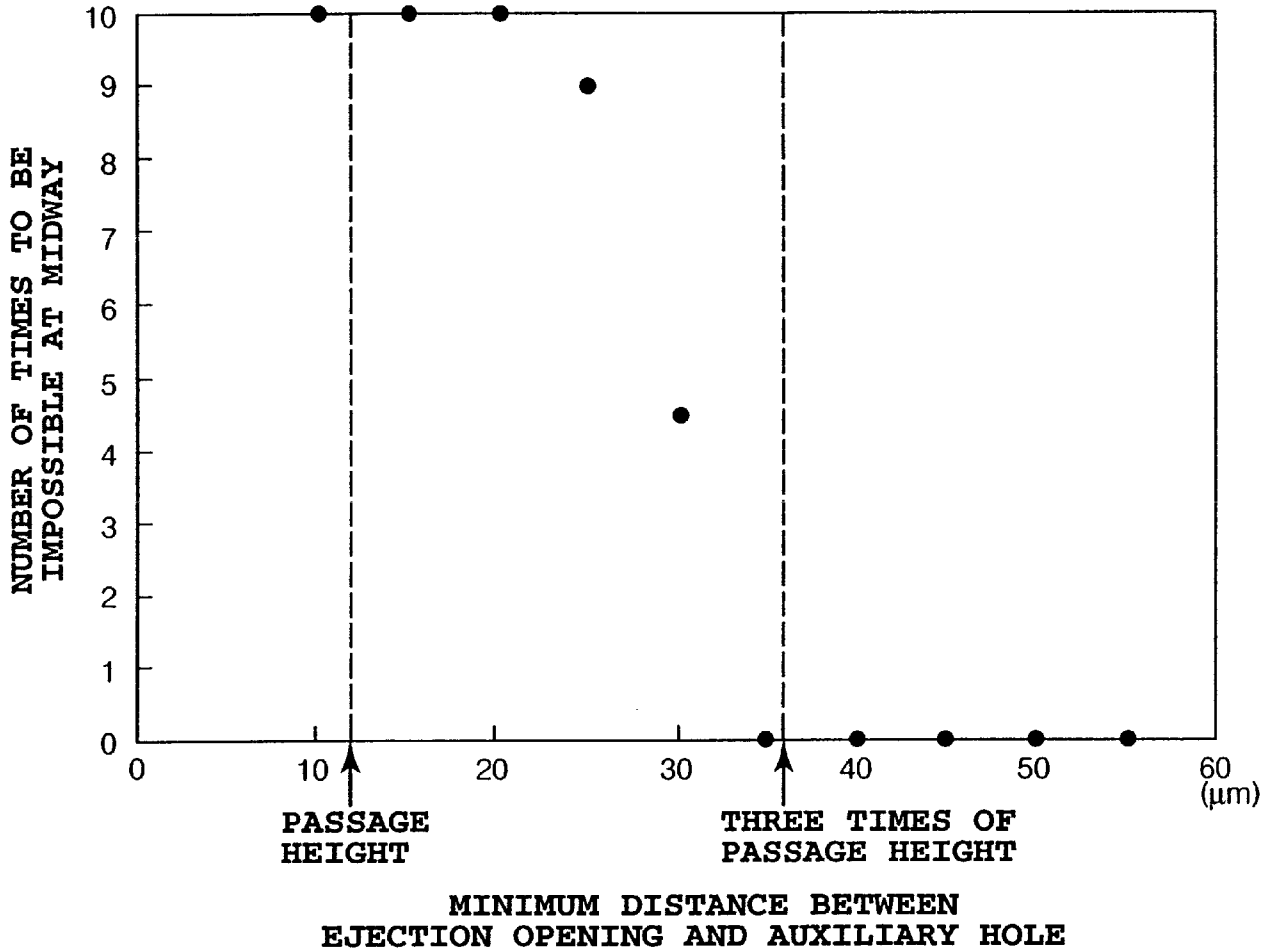
FIG. 7 is an explanatory illustration of an experiment data of effectiveness of the first embodiment of an ink-jet head according the present invention.
Figure 8:
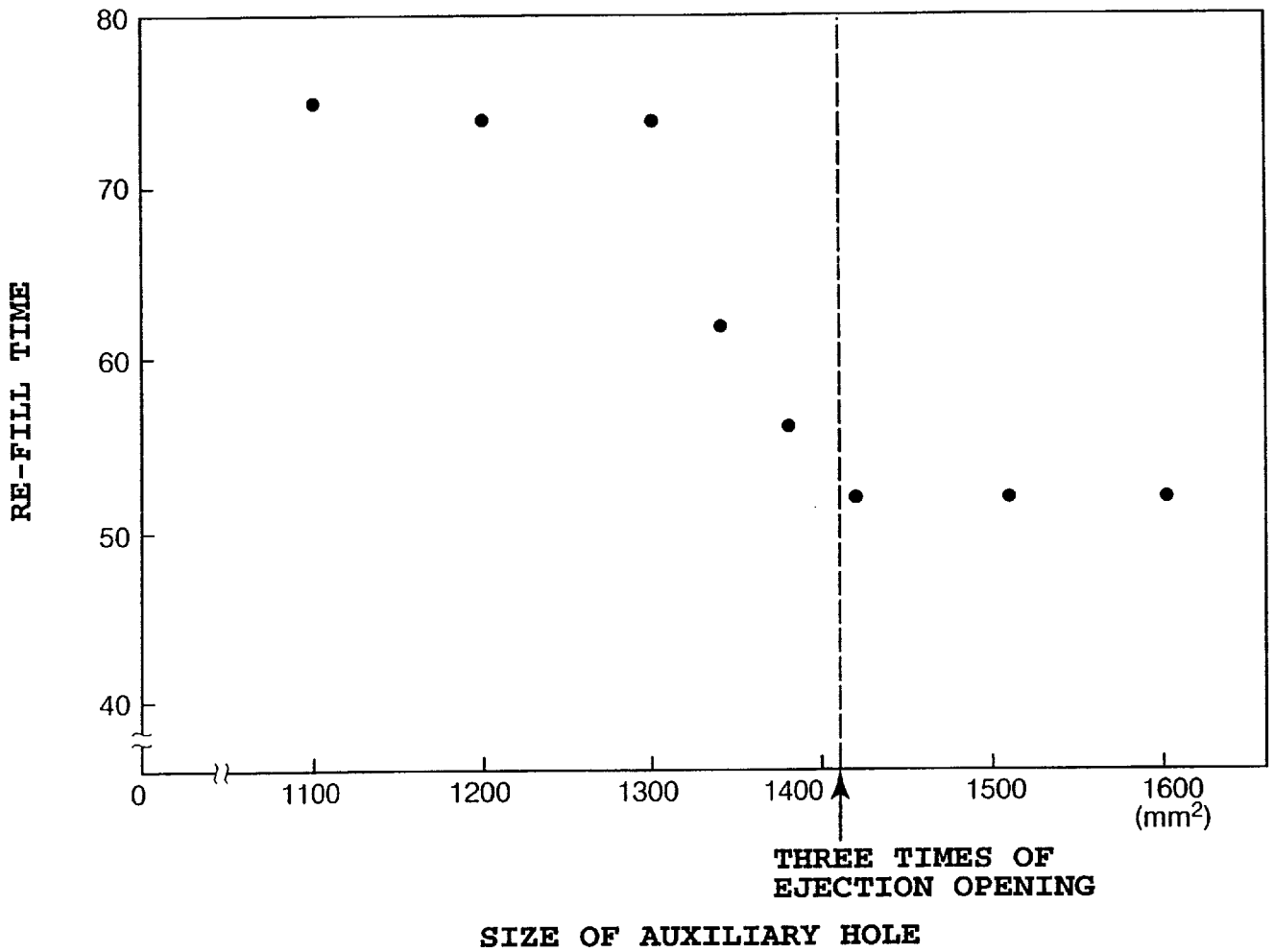
FIG. 8 is an explanatory illustration of an experiment data of effectiveness of the first embodiment of an ink-jet head according the present invention.

FIG. 7 shows a ratio to be impossible to print due to wetting of the ink around the ejection opening 12 during printing of one page of a printing paper of A4 size with varying the positions of the auxiliary hole 13, in the shown embodiment. Here, a vertical axis represents number of times to be impossible to print during a test for ten times. In the results of the above experiments for plural times, when the minimum distance L4 between the ejection opening 12 and the auxiliary hole 13 becomes shorter than three times of the height H1 of the liquid passage 14, the ratio to be impossible to print due to wetting of the ink around the ejection opening 12 is abruptly increased. FIG. 7 shows one instance of the results of the experiments for plural times, In FIG. 7, even when the minimum distance L4 is a little shorter than three times of the height H1, the times to be impossible to print is a zero. FIG. 8 shows a re-fill period when the size of the auxiliary hole 13 is varied. When the size (opening area) of the auxiliary hole 13 exceeds three times of the size (opening area) of the ejection opening 12, the re-fill time was stably shortened, It should be noted that, the highest limit size of the auxiliary hole 13 is preferably set smaller than a prescribed size which never spill out the ink due to maintaining the meniscus of the ink, if the auxiliary hole 13 turned to down direction.

(Second Embodiment)

In case of the shown embodiment, in order to make a pressure when the ink 17 is bulged from the auxiliary hole 13, to be elevated sufficiently high and to certainly maintain the volume to accumulate the bulging ink, a plurality of relatively small auxiliary holes 13 are provided.

Figure 4:
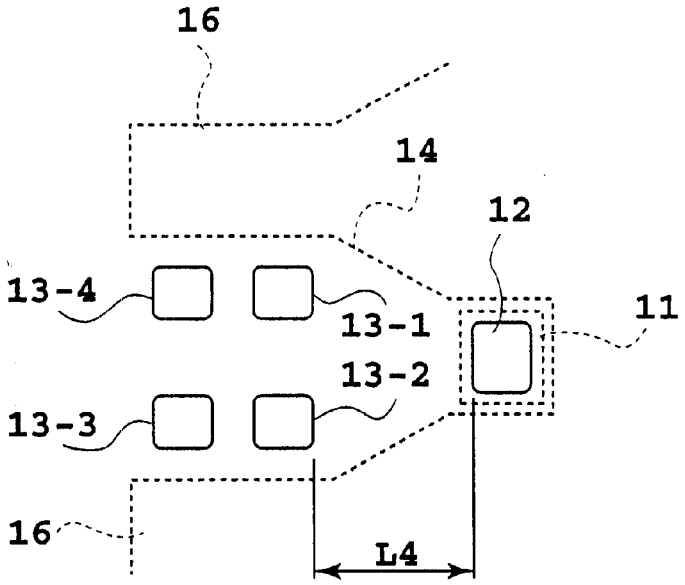
FIG. 4 is an enlarged plan view of the major part of the second embodiment of an ink-jet head according to the present invention.

FIG. 4 is a plan view of the major portion of the head in the shown embodiment. The construction is the same as the foregoing first embodiment except that four auxiliary holes 13-1, 13-2, 13-3 and 13-4 are provided. Each of the auxiliary hole 13-1 to 13-4 is 20 $\mu$m×20 $\mu$m. For each auxiliary hole 13-1 to 13-4, rounded portions of 4 $\mu$m of radius are provided at four corners. Effect of the shown embodiment becomes more remarkable than the case of the first embodiment. In the construction, the shown embodiment is differentiated from the first embodiment in that a plurality of auxiliary holes 13 (13-1 to 13-4) having smaller opening area than that of the auxiliary hole in the first embodiment, are provided. Overall opening area of the shown embodiment of the auxiliary hole 13, namely total of the opening area of the auxiliary holes 13-1 to 13-4 is slightly greater than that in the first embodiment. On the other hand, the auxiliary holes 13-3 and 13-4 are located at positions of greater distance from the ejection opening 12. However, size and position of the auxiliary hole 13 are particularly determined similarly to the first embodiment.

In the shown embodiment, since the opening area of each individual auxiliary hole 13-1 to 13-4 is small, when bubble grows, elevation of pressure due to bulging of the ink 17 from these auxiliary holes 13-1 to 13-4 becomes higher than that in the case of the first embodiment to shorten the re-fill time to be 45 $\mu$sec.

(Third Embodiment)

Figure 5:
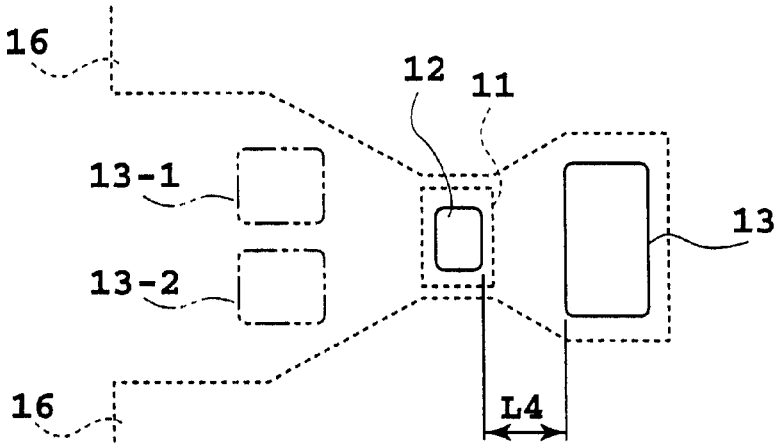
FIG. 5 is an enlarged plan view of the major part of the third embodiment of an ink-jet head according to the present invention.

FIG. 5 is a plan view of the major part of the third embodiment of a head according to the present invention. In the third embodiment, the auxiliary hole 13 is located at more distant position than the heater as viewed from the ejection opening (left side in FIG. 5). In the head of this type, the re-fill time can be shortened significantly. The re-fill time was 30 $\mu$sec at first ink droplet 17', 42 $\mu$sec at second ink droplet 17', 55 $\mu$sec at the third ink droplet 17', 65 $\mu$sec at the fourth ink droplet 17', and 71 $\mu$sec at the fifth ink droplet 17'. Namely, while good effect is achieved for the first ink droplet, effect was lowered in the subsequent ink droplets. However, as shown by two-dotted line in FIG. 5, by adding auxiliary holes 13-1 and 13-2 even between the supply opening 18 and the heater 11, the defect is solved and the re-fill time becomes stable at 48 $\mu$sec.

In any case, the size and the position of the auxiliary hole 13 at distal side of the heater 11 in the shown embodiment are particularly determined similarly to the foregoing first embodiment. Effectiveness to be achieved by particularly determining the size and the position of the auxiliary hole 13 at the distal side of the heater 11 can be confirmed by measuring a ratio of non-ejection due to wetting around the ejection opening (FIG. 7) and measuring of the re-fill time (FIG. 8), similarly to the first embodiment.

(Fourth Embodiment)

When a plurality of heaters 11 are provided in one head and are driven at different timing (time division), a distance from the heater 11 to the supply opening 12 may be differentiated. Namely, in so-called serial scanning system to perform printing by scanning the head, the ejection openings 12 arranged in row, are divided into a plurality of blocks. When the heaters 11 of respective blocks are driven in the time division, the positions of the ejection openings 12 per each block have to be shifted in scanning direction. If such offset is not caused, it becomes impossible to print a vertical line in a direction perpendicular to scanning direction, in straight line form. Due to so-called demand for straightness of the vertical line, the distance between the heater 11 and the supply opening 12 becomes different per block. In general, when a distance between the supply opening 12 and the heater 11 is longer, the re-fill time becomes longer. Therefore, it is effective to provide a plurality of the auxiliary holes 13 in number proportional to the distance between the supply opening 12 and the heater 11.

(Fifth Embodiment)

Figure 6:
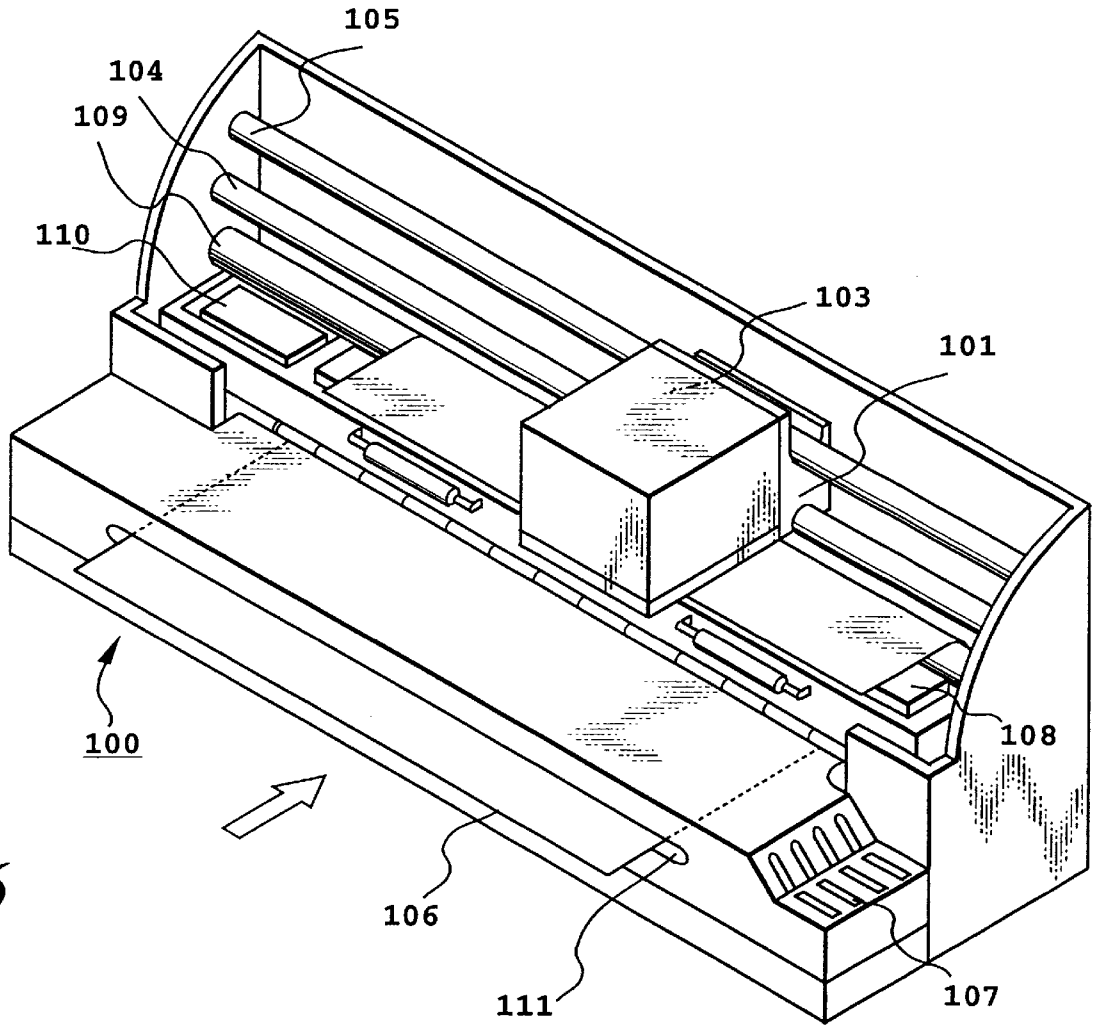
FIG. 6 is s perspective view of the fifth embodiment of an ink-jet printing apparatus according the present invention.

FIG. 6 is a perspective view showing general construction of the fifth embodiment of an ink-jet printing apparatus according to the present invention.

In an ink-jet printing apparatus 100, a carriage 101 is slidably engage with two guide shafts 104 and 105 extending in mutually parallel relationship with each other. The carriage 101 is reciprocally moved along the guide shafts 104 and 105 by a driving force transmitting mechanism (not shown), such as a driving motor and a belt to transmit a driving force thereof, and so on. On the carriage 101, an ink-jet unit 103 is mounted. The unit 103 has an ink-jet head 1 in the foregoing embodiment and an ink tank as an ink container employed in the head 1.

In the shown embodiment, the ink-jet head 103 comprises four heads respectively ejecting inks of four colors, black (Bk), cyan (C), magenta (M) and yellow (Y), and tanks respectively provided corresponding thereto. Furthermore, respective heads and tanks are detachable with each other. When the ink within the tank is spent out, only tank may be exchanged per individual color as required. On the other hand, it is matter of course that only head can be exchanged as required. It should be noted that a construction for attaching and detaching of the head and the tank is not specified to the foregoing example but that the head and the tank can be constructed integrally.

A paper 106 as a printing medium is inserted from an insertion opening 111 provided in the front end portion of the apparatus, and is finally reversed the transporting direction. Then, the paper 106 is transported to the lower side of the shifting region of the carriage 101. The head mounted on the carriage 101 performs printing on a printing region on the paper 106 supported by a platen 108 along its movement.

As set forth above, associating with shifting of the carriage 101, by repeating printing in a width corresponding to a width of ejection opening array of the head and feeding of the paper 106, alternately, printing is performed for overall paper 106 and thereafter, the paper is ejected toward front side of the apparatus.

On the left end of the region, in which the carriage 101 is movable, each head on the carriage 101 and a recovery system unit 110 which can be opposed on the lower side thereof are provided. The recovery unit 110 can perform operation to cap the ejection openings of respective head and operation of sucking the ink from the ejection openings of respective head and so forth, upon non-printing and so forth. On the other hand, the predetermined position on the left side end portion is set as a home position of the head.

On the other hand, on the right side end of the apparatus, an operating portion 107 having switches and display elements is provided. Here, switches are used for turning ON and OFF the power source of the apparatus, setting of various printing mode, and so forth , and the display elements serve for displaying various conditions of the apparatus.

(Sixth Embodiment)

Figure 9:
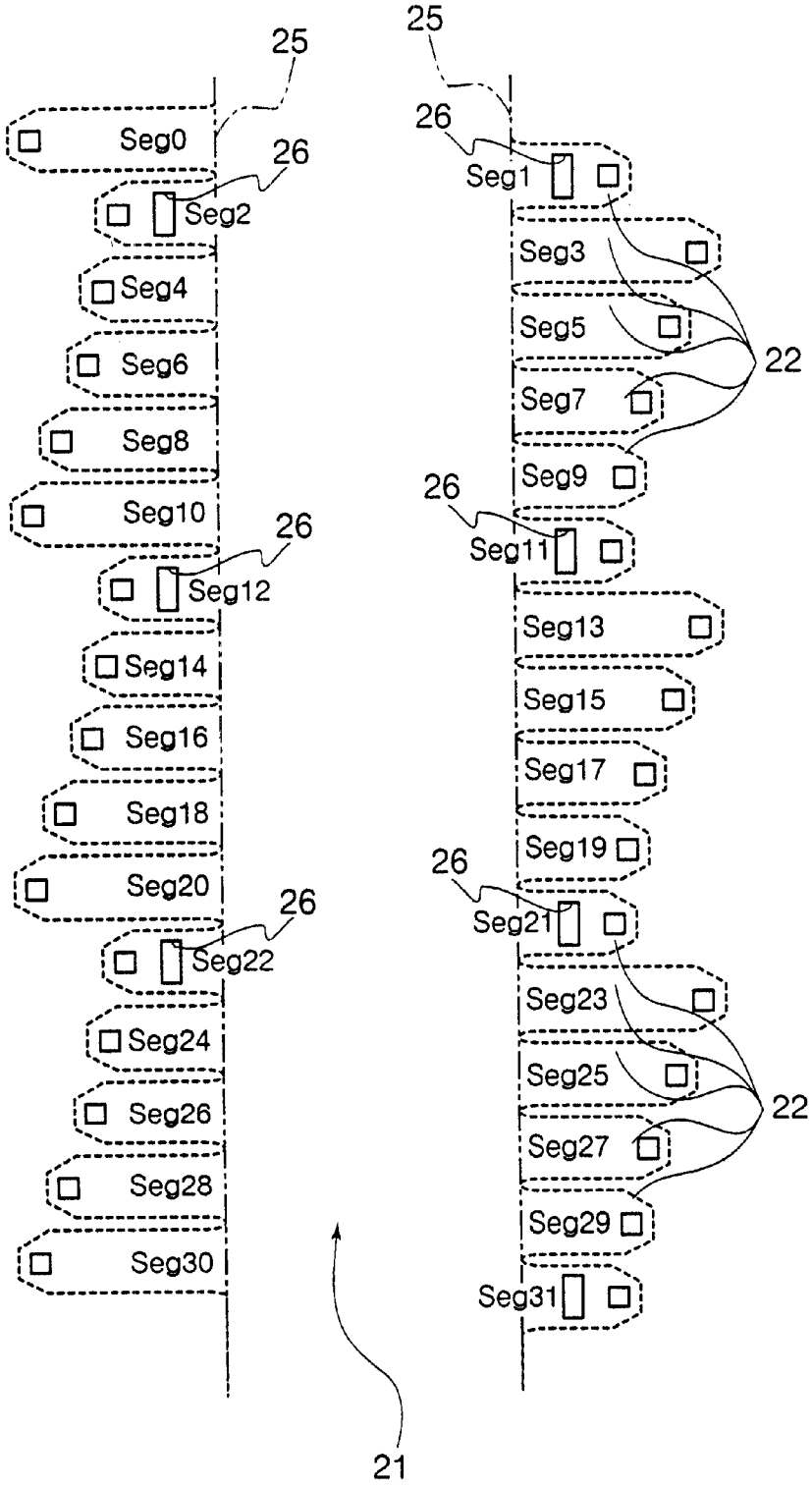
FIG. 9 is a plan view of the major part of an ink-jet head of the sixth embodiment according to the present invention.
Figure 15:
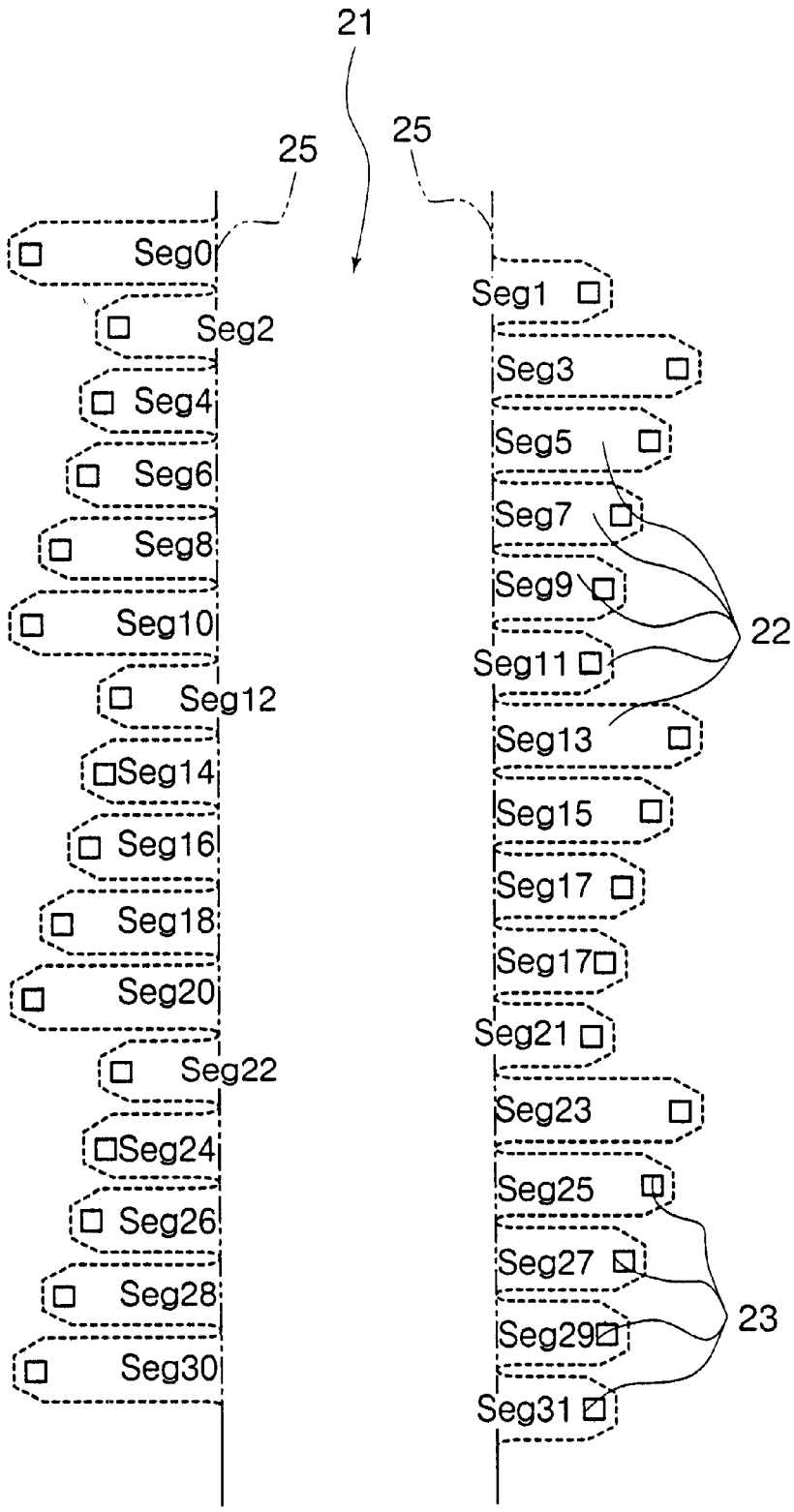
FIG. 15 is a plan view showing a major part of an ink-jet head in the background art.

FIG. 9 is an explanatory illustration diagrammatically showing the major part of the sixth embodiment of the ink-jet head (hereinafter also referred to as "ink-jet printing head") according to the present invention. The basic construction is similar to the example shown in FIG. 15. Two hundreds fifty-six ink passages 22 are branched from an ink supply passage 21. On the tip end of each ink passage 22, ejection openings 23 is provided, and a heater (electrothermal transducer) 24 (see FIGS. 12 and 13) as a thermal energy generating means is arranged in opposition to the ejection opening 23. Lengths of the ink passages 22 is slightly differentiated instead of making them uniform to enable high density printing by shifting the positions of the ejection openings 23.

The two hundreds fifty-six ink passages 22 are divided into the passages in even numbers of sequential order (hereinafter referred to as "even number passage") which are located on the left side in FIG. 1 and the passages in odd numbers of sequential order (hereinafter referred to as "odd number passage") which are located on the right side in FIG. 1. Each set, i.e. each of the even number passages and odd number passages, are grouped into sixteen groups per every eight ink passages. Also, similarly to the prior art shown in FIG. 15, each group is consisted of eight even number passages and eight odd number passages, and thus of sixteen passages in total. Then, upon printing, the heaters 24 of the sixteen ink passages 22 in the same group are driven simultaneously. Heaters are driven in sequential order from the first to sixteen groups. Thus, driving in time division is performed so that sixteen times of driving of the heaters constitutes one cycle. Since number of the passage is large, i.e. two-hundreds fifty-six, driving in time division manner is employed for restricting a current value to flow at a moment. An interval from driving of certain group to driving of the next group is 5.9 $\mu$sec.

It should be noted that, in FIG. 9, only thirty-two ink passages among two-hundreds fifty-six ink passages 22 are illustrated as Seg0 to Seg31 for convenience of illustration. It should be noted that the ink passages shown in FIG. 9 are not illustrated according to the actual dimension. Distances (C-H distance) from the branching position 25 between the ink supply passage 21 and the ink passages 22 to the center of the heaters 24 are differentiated per each ink passage 22. Concerning the even number passages on the left side of the drawing, the position of the center of the heater 24 of the ink passage Seg0 is taken as zero (0). The center of the heater 24 of the ink passage Seg2 is shifted toward right in the drawing in a magnitude of 0.0165 mm. In similar manner, the center positions of the center of the heaters 24 in the even number passages Seg4 . . . Seg30 are respectively located at positions with offset of 0.0125 mm, 0.0090 mm, 0.0050 mm, 0.0015 mm, 0.0175 mm, 0.0140 mm, 0.0100 mm, 0.0065 mm, 0.0025 mm, 0.0190 mm, 0.0150 mm, 0.0115 mm, 0.0075 mm and 0.0040 mm.

On the other hand, concerning the odd number passages on the right side, the center of the heater 24 of the ink passage Seg1 is located at a distance of 0.2960 mm toward right in the drawing from the center of the heater 24 of the ink passage Seg0. This center position of the heater 24 of the ink passage Seg1 is taken as zero, then, the center positions of the heaters 24 of the odd number passages of Seg3, Seg5 . . . Seg31 are respectively located at positions with offsets of 0.0165 mm, 0.0125 mm, 0.0090 mm, 0.0050 mm, 0.0015 mm, 0.0175 mm, 0.0140 mm, 0.0100 mm, 0.0065 mm, 0.0025 mm, 0.0190 mm, 0.0150 mm, 0.0115 mm, 0.0075 mm, 0.0040 mm. As set forth above, positional relationship of the odd number passage is similar to that of the even number passages.

Thus, each ink passages 22 are generally separated into five kinds depending upon C-H distances. Namely, the even number passages Seg2, Seg12 and Seg22 and the odd number passages Seg1, Seg11, Seg21 and Seg31 are the ink passage groups having the shortest C-H distance. The ink passages groups consisted of Seg4, Seg14, Seg24, Seg9, Seg19 and Seg29 have the second shortest C-H distance. Subsequently, in sequential order from the group having the next shorter C-H distance, the ink passage group having the third shortest C-H distance is consisted of passages Seg6, Seg16, Seg26, Seg7, Seg17, Seg27, and the ink passage group having the next shorter C-H distance is consisted of passages Seg8, Seg18, Seg28, Seg5, Seg15, Seg25. The ink passage group consisted of Seg0, Seg10, Seg20, Seg30, Seg3, Seg13, Seg23 has the longest C-H distance. It should be noted that since the center of the ejection opening 23 and the center of the heater 24 are located in opposition, distance from the branching position 25 between the ink supply passage 21 and the ink passage 22 to the ejection opening 23 is consistent with the C-H distance.

Figure 10:
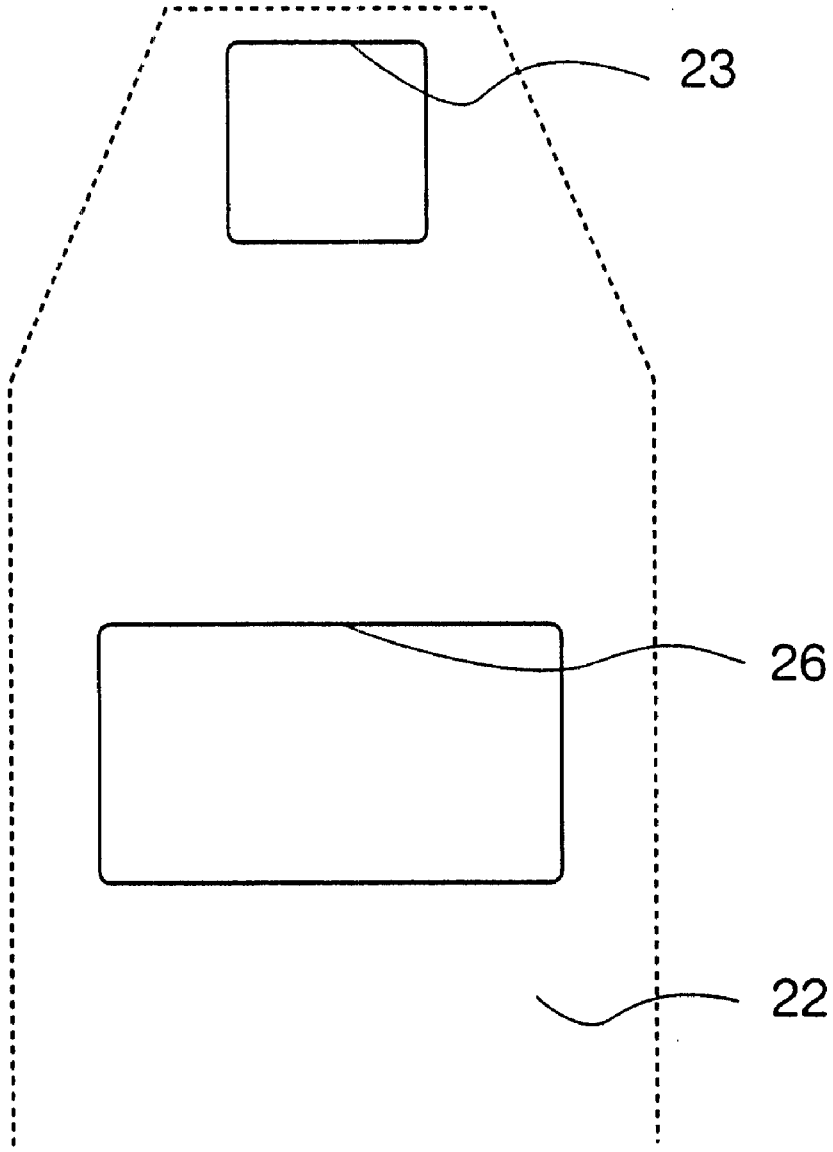
FIG. 10 is a partial enlarged view of FIG. 9.

In the shown embodiment, between the ejection opening 23 and the heater 24, and the branching position 25 of respective ink passages of the ink passage groups having the shortest C-H distance, auxiliary holes (hereinafter referred to as "pressure buffering dummy hole") 26 are provided as shown in FIGS. 9 and 10.

When a drive signal driving the Seg0 to Seg31 is input, the drive pulse is applied to the heater 24 in sequential order from the first group to the sixteenth groups. For example, the ink passage (Seg22) of the sixteenth group of even number receive hydrodynamic influence from all other ink passages (Seg0 to Seg21 and Seg24 to Seg31) through which ejection of ink droplets is performed in advance, up to immediately preceding timing of ejection of the ink droplet.

Figure 17:
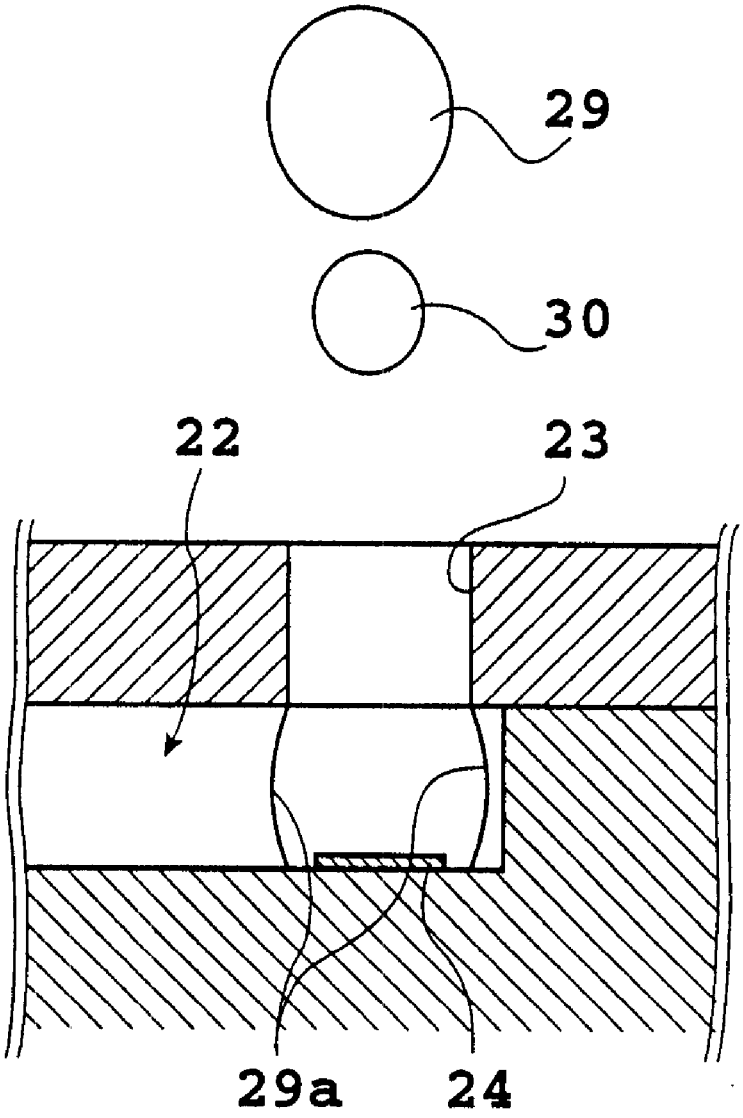
FIG. 17 is an explanatory illustration showing an ejecting condition of the ink droplet in the ink-jet head associating with the background art.

Namely, in case of the ink-jet printing head of the bubble-jet type, bubble is generated in the ink by heating of the heater 24 to eject the ink droplet through the ejection opening 23 by the pressure of the bubble. Subsequently, the bubble is returned into the liquid and thus is extinguished. Thereafter, the ink is supplied from the ink supply passage 21 to the ink passage 22. Thus, within the ink passage 22, variation of pressure and vibration are internally caused through the process of generation of bubble—ejection of ink droplet—extinction of bubble—supply of ink. Since all ink passages 22 are connected by the ink supply passage 21, influence of ejection of the ink droplet in other ink passages is inherently transmitted. In the example shown in FIG. 9, the ink passage (Seg22) of the sixteenth group receives influence of ejection of the ink droplet of other ink passages in other fifteen times to cause pressure variation and vibration in the ink therein. Therefore, conventionally, the meniscus at the tip end of the ink passage having shorter C-H distance than others is influenced by pressure variation and vibration of the ink upon ejection of the ink droplet in other ink passages to gradually bulge outwardly with causing vibration. Therefore, when ejection of the ink droplet is performed at this condition, broken droplet ejection phenomenon can be caused as shown in FIG. 17.

Figure 11:
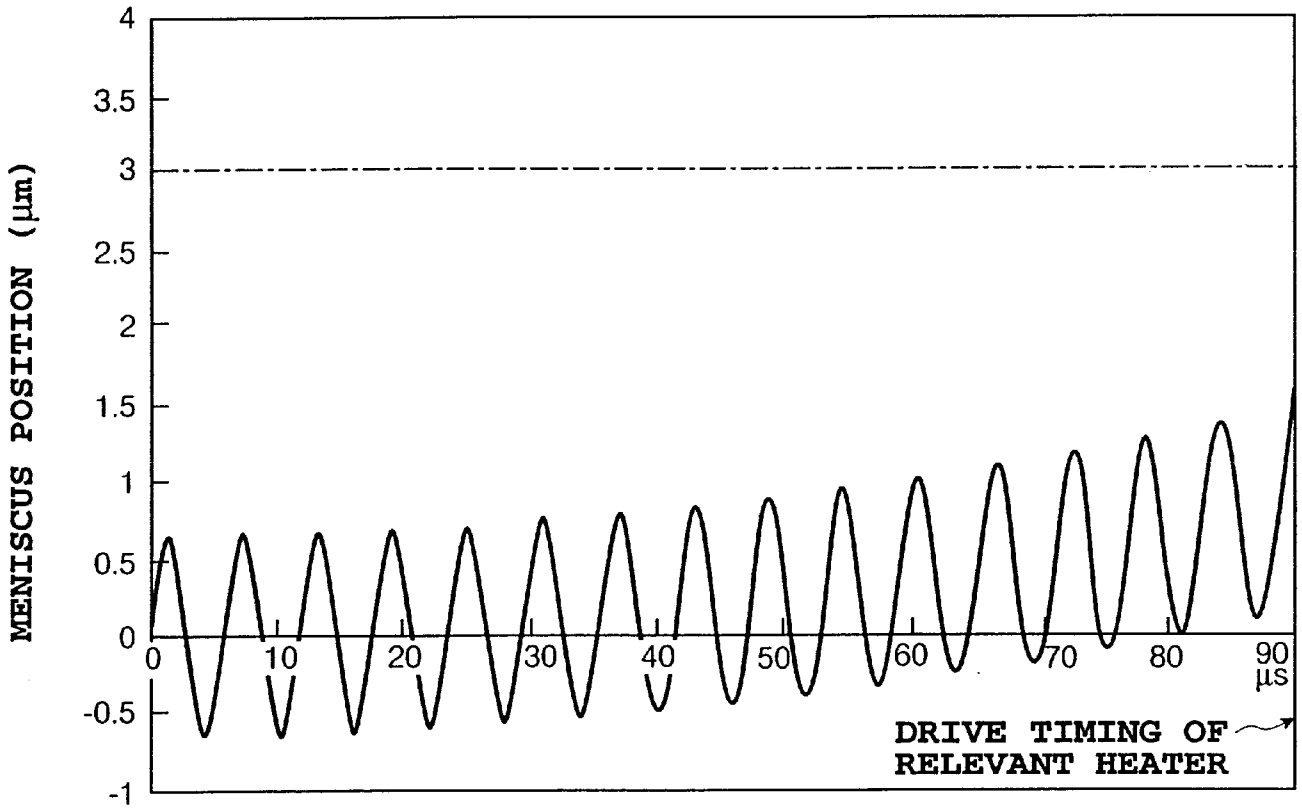
FIG. 11 is an explanatory illustration showing fluctuation of a meniscus position in the sixth embodiment according to the present invention.
Figure 12:
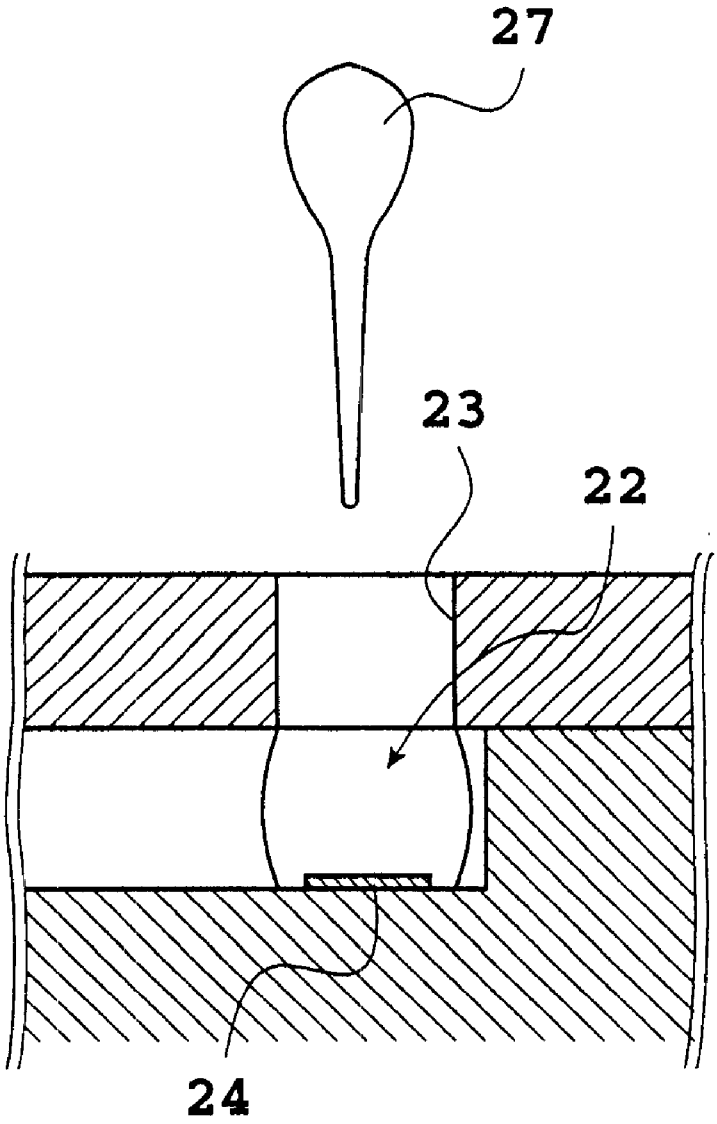
FIG. 12 is an explanatory illustration showing an ejecting condition of an ink droplet in the sixth embodiment according to the present invention.
Figure 13:
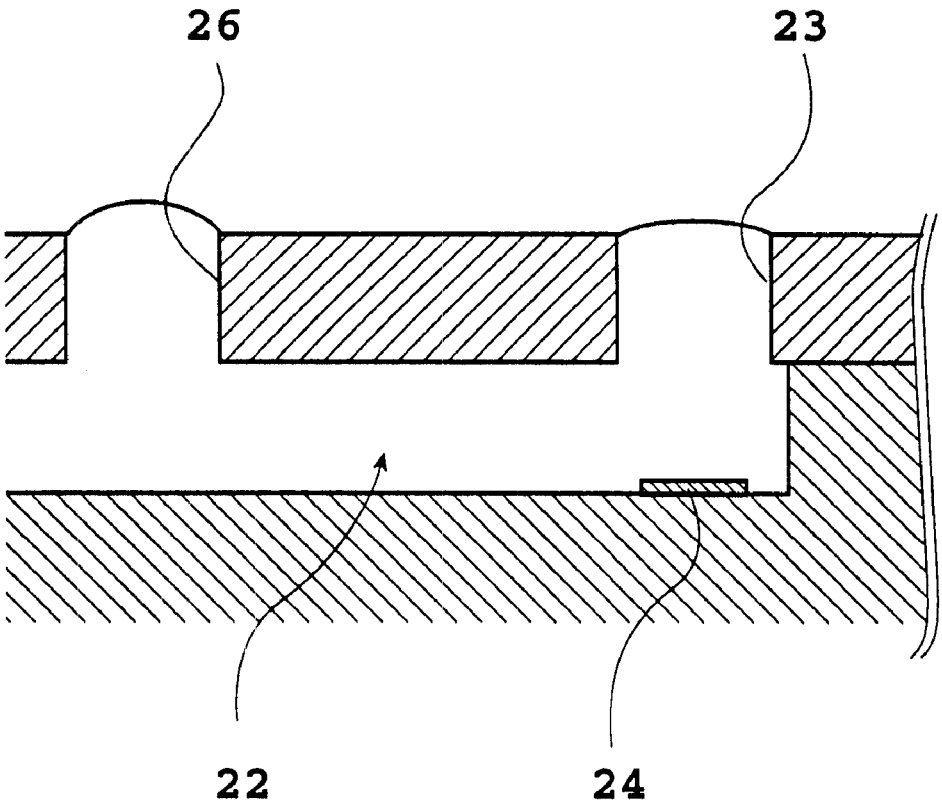
FIG. 13 is an explanatory illustration showing absorbing condition of pressure fluctuation and vibration of ink by a dummy hole portion in the sixth embodiment according to the present invention.
Figure 16:
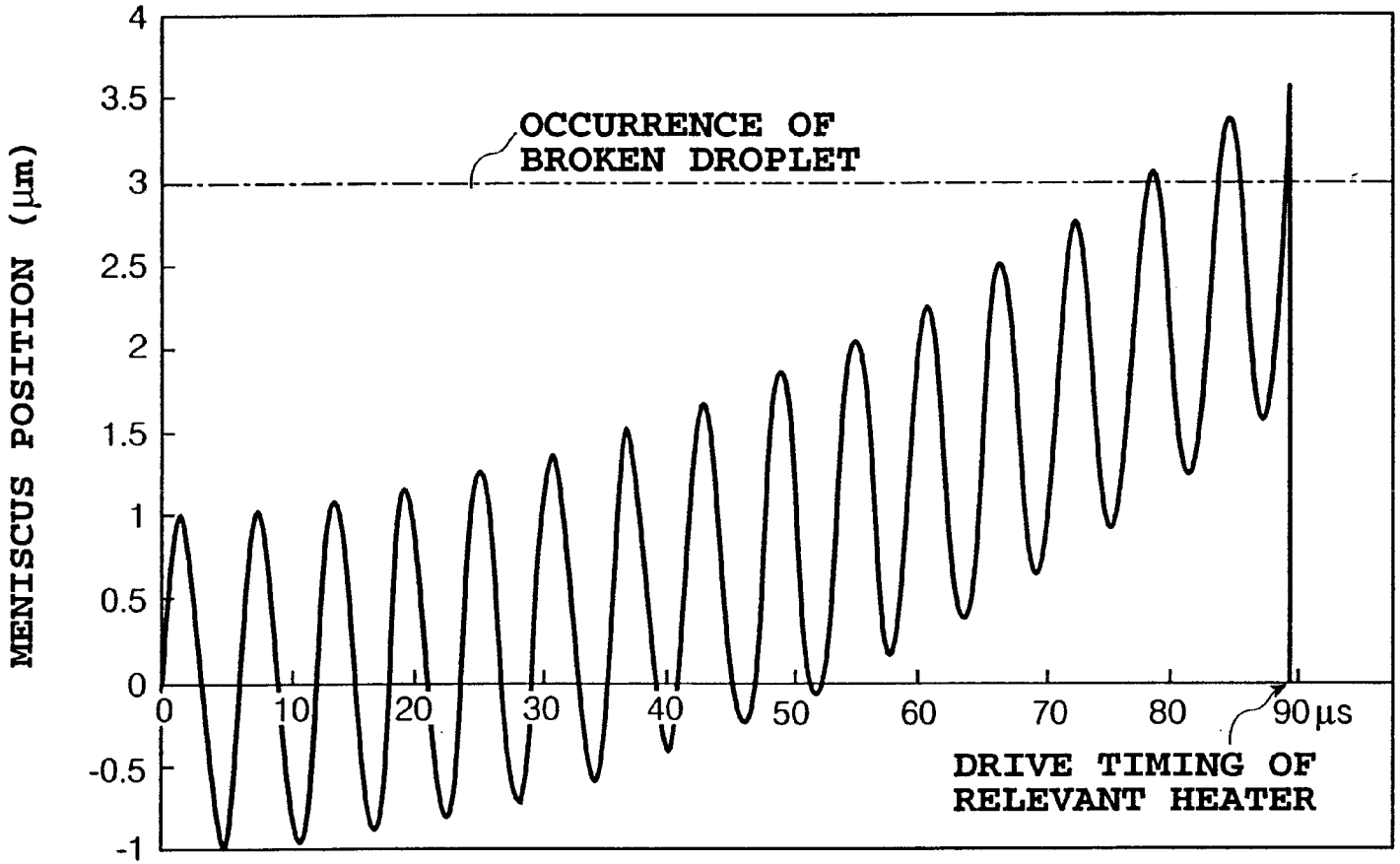
FIG. 16 is an explanatory illustration showing fluctuation of a meniscus position in an ink-jet head associating with the background art.

However, in the shown embodiment, the dummy hole 26 is provided between the branching position 25 of the ink passage Seg22 and the heater 24. Accordingly, since the ink is outwardly bulged to project from the dummy hole 26, pressure variation and vibration due to ejection of the ink droplet in other ink passages can be buffered. As a result, the meniscus will not excessively project outwardly from the ejection opening 23. In the prior art, the meniscus is bulged and retracted at the ejection opening 23 according to ejection of the ink droplet in other ink passages (see FIG. 16). In the shown embodiment, the ink may bulged and retracted at the dummy hole 26 in similar manner as shown in FIG. 13. As a result, in the meniscus at the ejection opening 23, pressure variation and vibration do not transmitted directly and are buffered in certain extent to make variation of the meniscus smaller (see FIG. 11). Accordingly, upon ejection of the ink droplet, as shown in FIG. 12, the broken droplet ejection phenomenon will not be caused and one ink droplet 27 with a tail can be normally ejected. Since the ink droplet 27 to be ejected becomes the equivalent size as the droplet from other ejection opening, even when black solid printing is performed, black stripe locally having higher density will never be generated.

The ink passage, in which ejection of the ink droplet is to be performed, is supplied the ink from the ink supply passage. Vibration in the ink passage is once stabilized, the meniscus is returned to the position of zero. When driving of the first to sixteenth groups is repeated, with respect to the meniscus of the ink passage Seg22, a waveform between 0 to 90 $\mu$sec is repeated as shown in the graph of FIG. 11. It should be noted that the dummy hole 26 is provided at a position sufficiently distanced from the heater 24. Therefore, when the ink droplet is ejected from the ejection opening 23, the ink in the dummy hole 26 is maintained by surface tension to be bulged and retracted but will never be leaked out.

On the other hand, in the construction set forth above, concerning odd number passage, the dummy holes 26 are provided for the ink passages Seg1, Seg11, Seg21 and Seg31 of the first to fourth group to be driven to perform ink ejection in the first half of one cycle. When driving cycle of the first to sixteenth groups is repeated, the odd number passage is merely shifted the timing slightly as the case of the even number passage. Therefore, similarly to the case of the even number passage, pressure variation and vibration of the ink can be buffered by the dummy hole 26. Accordingly, even from the odd number passage, normal ejection as shown in FIG. 12 is performed. Therefore, the ink droplet to be ejected will not become greater in comparison with the ink droplet ejected from other ejection opening located therearound.

(Seventh Embodiment)

In the foregoing sixth embodiment, the dummy hole 26 is formed in the ink passage group having the shortest C-H distance. However, the ink passage, to which the dummy passage is to be provided, can be set arbitrarily. For example, while not illustrated, as the seventh embodiment, the dummy holes 26 (see FIG. 10) similar to those in the sixth embodiment may be provided in the ink passage groups (Seg0, Seg3, Seg10, Seg13, Seg20, Seg23) having the longest C-H distance.

As discussed above, in the sixth and seventh embodiments, broken droplet ejection phenomenon can be avoided by providing the dummy hole 26 in the ink passage 22. When the dummy holes are provided in too many ink passages 22, the mechanical strength of the ejection opening plate, in which the ejection opening 23 is formed, is lowered. Also, the viscosity of the ink is increased due to increasing of overall evaporation amount of the volatile component in the ink, and so non-ejection can be increased. Therefore, as in the sixth and seventh embodiment, it is preferred to provide the dummy hole 26 in about 20% to 30% of ink passages. Also, the ink passages 22 provided the dummy holes 26 is preferably arranged in the overall ink passages 22 without causing local concentration.

On the other hand, in the sixth and seventh embodiments, the dummy holes 26 can be provided in the same condition as the auxiliary holes 13 in the first to fourth embodiments. The similar effects as the first to fourth embodiments, such as improvement of reliability of ink ejection, shortening of re-fill time of the ink and so forth, can be achieved.

(Eighth Embodiment)

Figure 14:
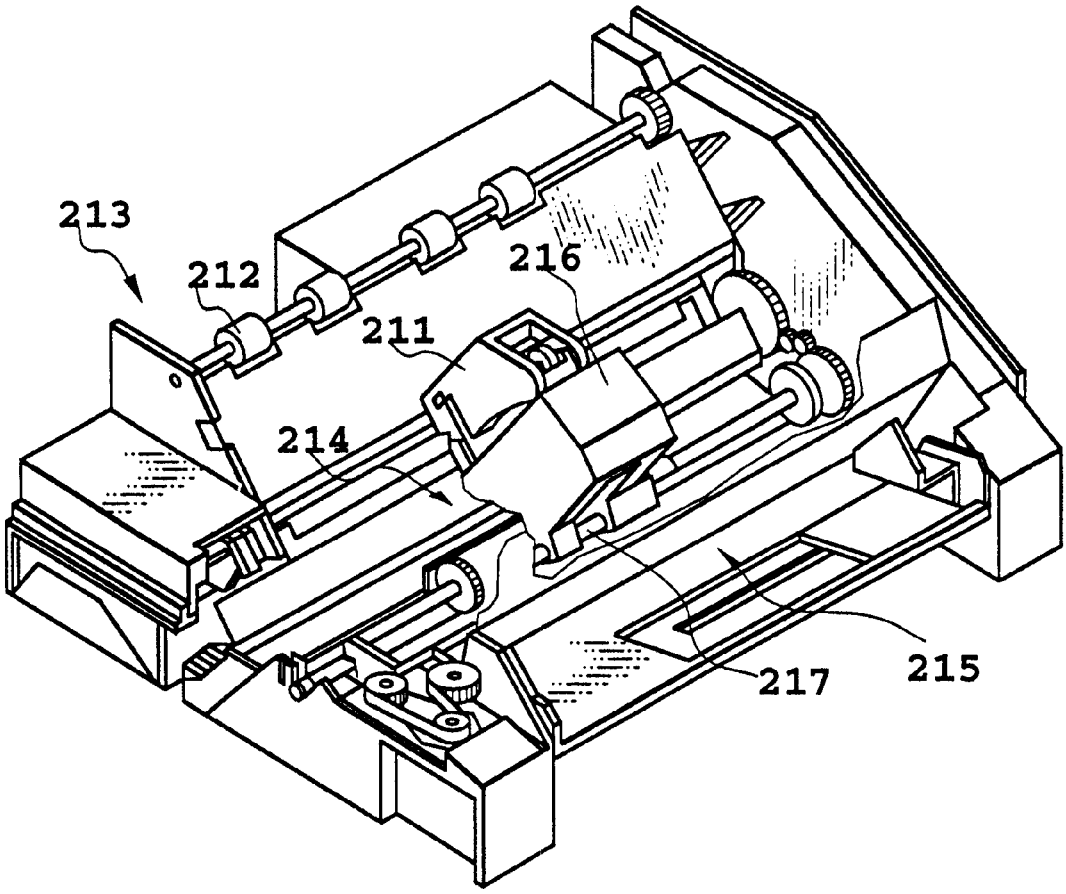
FIG. 14 is a perspective view of an ink-jet printing apparatus according to the present invention.

In FIG. 14, there is illustrated the ink-jet printing apparatus having the ink-jet printing head 211 having the construction in the sixth to seventh embodiments. Simply explaining the construction of the printing apparatus, the printing apparatus include a paper supply portion 213 having the supply roller 212 or so forth for supply the printing medium (not shown), such as the paper or so forth, a printing portion 214 performing ink ejection from the ink-jet printing head 211 to the printing medium, and a paper ejecting portion 215 ejecting the printed printing medium. In the printing portion 214, a carriage as means for mounting the ink-jet printing head 211 is provided for sliding movement along the guide rail 217. On the carriage 216, the ink-jet printing head 211 is mounted. These are integrally reciprocated in a direction substantially perpendicular to the transporting direction of the printing medium.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. An ink-jet head for ejecting ink, comprising:

an ink supply passage;

a plurality of ink passages each communicating with said supply passage;

a plurality of ejection openings for ejecting ink provided for respective ones of said ink passages; and a plurality of electrothermal transducers located in correspondence to respective ones of said ejection openings for generating thermal energy to be applied to ink within said ink passages, respectively, and utilized to eject ink from said ejection openings, respectively, wherein at least one of said ink passages has a plurality of auxiliary holes opened to the outside, and wherein said auxiliary holes are provided in correspondence to respective ones of said ejection openings and, for each of said ink passages, opening areas of said auxiliary holes are smaller than an opening area of said respective ejection opening.

2. An ink-jet head as claimed in claim 1, wherein said auxiliary holes are provided in correspondence to respective ones of said ejection openings and, for each of said ink passages, a total opening area of said auxiliary holes is greater than or equal to three times an opening area of said respective ejection opening.

3. An ink-jet head as claimed in claim 1, wherein said auxiliary holes are provided in correspondence to respective ones of said ejection openings and, for each of said ink passages, minimum distances between said auxiliary holes and said respective ejection opening are greater than or equal to three times a height of said ink passage.

4. An ink-jet head as claimed in claim 1, wherein each of said ink passages has said plurality of auxiliary holes.

5. An ink-jet head as claimed in claim 1, wherein at least one of said auxiliary holes is located at a rear side of said respective ejection opening in an ink supply direction.

6. An ink-jet head as claimed in claim 1, wherein at least one of said auxiliary holes is located at a front side of said respective ejection opening in an ink supply direction.

7. An ink-jet head as claimed in claim 1, wherein a plurality of said ink passages are divided into N groups and said electrothermal transducers are driven per group sequentially in time division with N divisions, and at least 1/N of all of said ink passages are provided with said auxiliary holes.

8. An ink-jet head as claimed in claim 1, further comprising:

for each of said ink passages, a branching portion between said ink passage and said ink supply passage, such that there is an interval between said branching portion and said respective electrothermal transducer in said ink passage, wherein, among said plurality of ink passages, said auxiliary holes are provided in each of said ink passages for which the interval is shorter than that for others of said ink passages.

9. An ink-jet head as claimed in claim 1, further comprising:

for each of said ink passages, a branching portion between said ink passage and said ink supply passage, such that there is an interval between said branching portion and said respective electrothermal transducer in said ink passage, wherein, among said plurality of ink passages, said auxiliary holes are provided in each of said ink passages for which the interval is longer than that for others of said ink passages.

10. An ink-jet head as claimed in claim 1, wherein said ejection openings communicate a bubble with the atmosphere during a process of growth of the bubble generated in ink.

11. An ink-jet head as claimed in claim 1, wherein said ejection openings are located opposite said respective electrothermal transducers.

12. An ink-jet head as claimed in claim 1, wherein said ink passages are provided between a substrate in which said electrothermal transducers are provided and an ejection opening formation member in which said ejection openings are formed, and said auxiliary holes are formed in said ejection opening formation member.

13. An ink-jet head as claimed in claim 12, wherein said ejection openings and said auxiliary holes are located opposite said substrate.

14. An ink-jet printing apparatus including:

an ink-jet head as claimed in claim 1; and shifting means for relatively shifting said ink-jet head and a printing medium.

15. An ink-jet printing apparatus as claimed in claim 14, wherein said shifting means reciprocally moves said ink-jet head in a primary scanning direction, and shifts the printing medium in an auxiliary scanning direction substantially perpendicular to the primary scanning direction.

16. An ink-jet head for ejecting ink, comprising:

an ink supply passage;

a plurality of ink passages branched from said ink supply passage;

a branching portion between said ink supply passage and each of said ink passages, respectively;

a plurality of ejection openings provided at respective tip ends of said ink passages; and a plurality of electrothermal transducers located in correspondence to respective ones of said ejection openings for generating thermal energy to be applied to ink within said ink passages, respectively, and utilized to eject ink from said ejection openings, respectively, wherein at least one of said ink passages has a plurality of auxiliary holes for buffering pressure variation and vibration of ink provided between said respective branching portion and said respective electrothermal transducer in said ink passage, and wherein said auxiliary holes are provided in correspondence to respective ones of said ejection openings and, for each of said ink passages, opening areas of said auxiliary holes are smaller than an opening area of said respective ejection opening.

17. An ink-jet head for ejecting ink, comprising:

an ink supply passage;

a plurality of ink passages each communicating with said supply passage;

a plurality of ejection openings for ejecting ink provided for respective ones of said ink passages; and a plurality of electrothermal transducers located in correspondence to respective ones of said ejection openings for generating thermal energy to be applied to ink within said ink passages, respectively, and utilized to eject ink from said ejection openings, respectively, wherein at least one of said ink passages has a plurality of auxiliary holes opened to the outside, and wherein at least one of said auxiliary holes is located at a front side of said respective ejection opening in an ink supply direction.

* * * * *